United States Patent [19]

Smith et al.

[11] 4,022,502

[45] May 10, 1977

[54] ARM OR CUSHION SUPPORT FOR FURNITURE

[75] Inventors: David Lynn Smith; Mary B. Lupton, both of Chicago, Ill.

[73] Assignee: Plurielle, Inc., Chicago, Ill.

[22] Filed: Dec. 22, 1975

[21] Appl. No.: 643,519

[52] U.S. Cl. ..... 297/414; 5/52; 5/327 R; 297/352; 297/416; 297/422

[51] Int. Cl.[2] ..... A47C 7/54

[58] Field of Search ..... 5/52, 59 B, 59 C, 327 R, 5/327 B; 297/227, 218, 352, 411, 412, 414–416, 422, 444, 460

[56] References Cited

UNITED STATES PATENTS

| | | | |
|---|---|---|---|
| 3,074,762 | 1/1963 | Kris | 297/416 |
| 3,639,929 | 2/1972 | Ichise | 5/327 R |
| 3,669,498 | 6/1972 | Meyers et al. | 297/460 X |

*Primary Examiner*—James C. Mitchell
*Attorney, Agent, or Firm*—Howard B. Rockman

[57] ABSTRACT

The invention provides a support for a cushion — primarily an arm cushion — on furniture. A frame with a curved ladder back form has a long straight part which fits under the cushions of a seat. The curved portion of the ladder back form extends from the long part outwardly and around the seat cushion. Thereafter, a short straight part of the ladder back form rises from the curved part to receive and support an arm cushion. A plurality of different cushions may be substituted for each other to change the overall appearance of the device including the seat cushion.

11 Claims, 11 Drawing Figures

ARM OR CUSHION SUPPORT FOR FURNITURE

This invention relates to furniture design and construction and more particularly means for providing an optional cushion support — and especially arm support — for such furniture.

One of the reoccuring problems with almost every style, shape, and form is the need for multiple purpose usage. For example, a person living in a small apartment has need for an item which may be a sofa by day and a bed by night. Also, a chair which is normally upright may convert into a recliner. Sectional units may be pushed together to form a sofa or pulled apart to form individual chairs or love seats. Also, the problem of flexibility of design may come into play. At one time, a person may buy furniture having, say, cylindrical, rounded, or curved appearances. At another time, the person might want to convert the same furniture to angular, box-like, or straight line appearance. Or, a person may want upholstery in a solid color at one time and a pattern at another time.

Accordingly, an object of the invention is to provide new and improved means for and methods of varying furniture construction and appearance. Here, an object is to provide means for and methods of forming and mounting arms, especially on cushioned furniture. In this connection, an object is to provide means for forming such arms with a flexibility that enables change and correction of furniture design.

Another object of the invention is to provide general purpose furniture construction which enables quick and easy installation and change while providing very strong and stable structures.

Yet another object is to provide low cost furniture having high quality.

In keeping with an aspect of the invention, these and other objects are accomplished by providing a frame with a curved ladder back form, having a long straight part which fits under the cushions of a seat. The curved portion of the form extends the form outwardly and around the seat cushion. Thereafter, a short straight part rises from the curve to receive and support an arm cushion. A plurality of different cushions may be substituted for each other to change the appearance of the device including the seat cushion.

The nature of a preferred embodiment of the invention may be understood best from a study of the attached drawings wherein.

Figure 1:
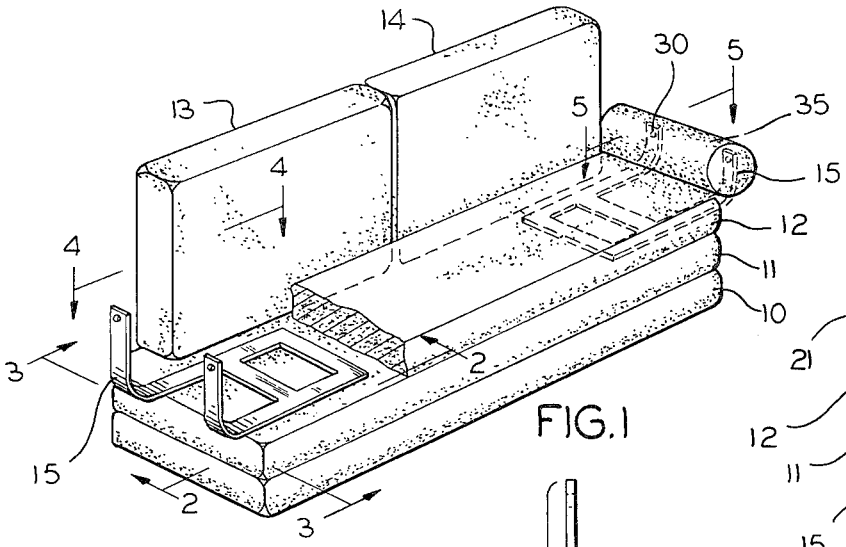
FIG. 1 is a perspective view of an exemplary sofa, partly in cross section, showing the inventive construction.

The sofa of FIG. 1 comprises a plurality of seat cushions 10–12, stacked, one on the other. It is anticipated that these cushions will be placed against a wall, or other suitable vertical structure. Therefore, one or more back cusions 13, 14 may be vertically placed on top of the uppermost seat cushion 12 and leaned against the wall. As an alternative, a ladder back frame 15 may be used, as described below, to support the back cushions.

Figure 2:
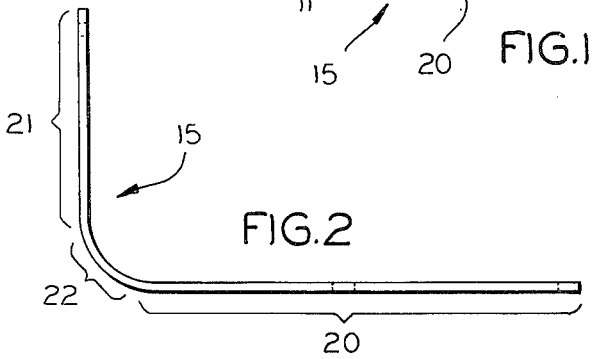
FIG. 2 is a side elevation of the ladder back frame construction looking in the directions of the arrows, from the plane 2—2 of FIG. 1.
Figure 3:
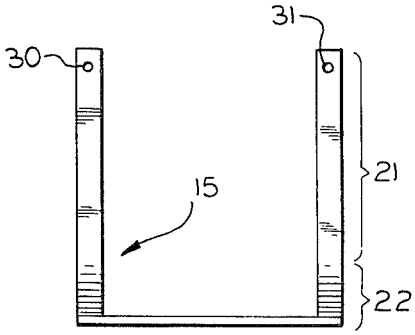
FIG. 3 is a front elevation of the ladder back construction looking in the direction of the arrows from the plane 3—3 of FIG. 1.
Figure 4:
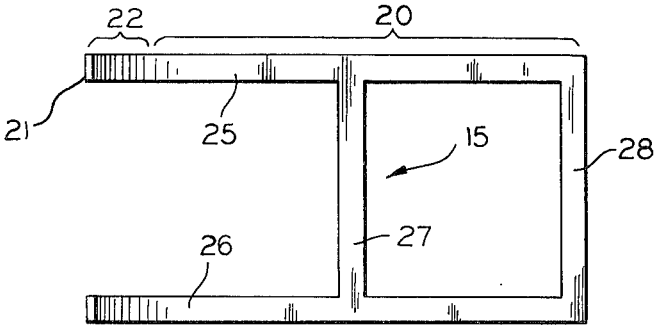
FIG. 4 is a plan view of the ladder back construction looking in the direction of the arrows from the plane 4—4 of FIG. 1.

The ladder back frame (FIGS. 2–4) comprises a long end 20 and a short end 21, both of which are essentially straight, in cross section. The portion between these two straight parts 20, 21 has an arcuate section 22, which is preferably a segment of a circle.

The ladder back frame further comprises two side sections 25, 26 joined together in the long section 20 by two or more perpendicularly oriented spacers 27, 28 which may be welded in place. The welds are then ground smooth and all burrs, sharp corners, and the like are removed. Therefore, the ladder back is given a smoothness which prevents undue wear upon the underside of the seat cushions. There are cushion-position fixing openings 30, 31 on the free end of each of the short ends 21 of the side rails 25, 26.

Figure 11:
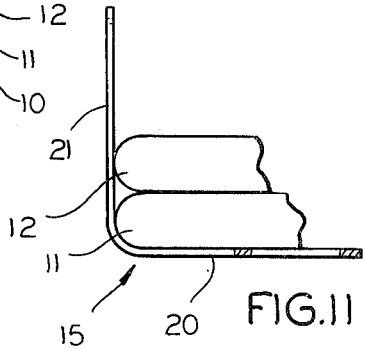
FIG. 11 is a side elevation of the ladder back frame construction with two seat cushions stacked upon it, looking in the direction of the arrows 2—2 of FIG. 1.

From an inspection of FIG. 1, it will be seen that the long end 20 of the ladder frame may be slipped between seat cushions 11, 12 or, as shown in FIG. 11, it may be slipped under cushions 11 and 12. The curved section 22 extends out beyond the end of cushion 12 for a distance which is far enough to form a comfortable arm. The short end 21 raises high enough above the upper side of cushion 12 to form a comfortable arm height surface, when an arm cushion is in place on the ladder back frame.

The principle of the invention is that the weight of the person sitting on top of the cushion 12 anchors and fixes in position the long part 20 of frame 15. Therefore, there is no need to further anchor the arm.

Figure 5:
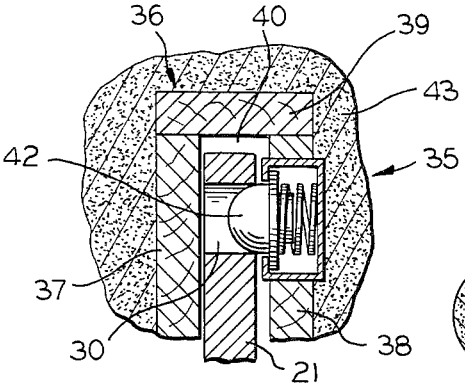
FIG. 5 is a fragmentary cross sectional view taken along line 5—5 of FIG. 1.

Each arm cushion 35 is a padded device built in any convenient shape, size and manner. In greater detail, the core of the arm cushion may be a box 36, FIG. 5, made of any suitable material, such as wood, or molded plastic, for example. When wood is used, side panels 37, 38 are joined together by a top panel 39. The space 40 defined by panels 37–39 provides sufficient clearance for receiving the short ends 21, which fit therein. When they do so fit, a spring loaded detent 42 snaps into the position fixing hole 30. Thereafter, the arm cushion 35 may be pulled off the ladder back frame 15 but not without a use of force sufficient to pull detent 42 out of the hole 30.

Figure 6:
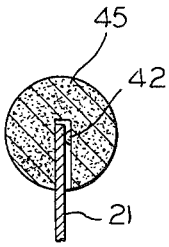
FIGS. 6—10 are also cross sections, also taken along line 5—5 of FIG. 1, to show how both the appearance and the function of the sofa may be changed by substituting arm cushions.
Figure 7:
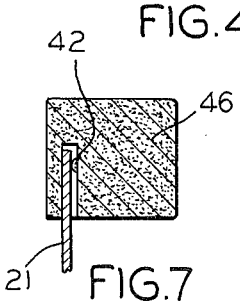
Figure 8:
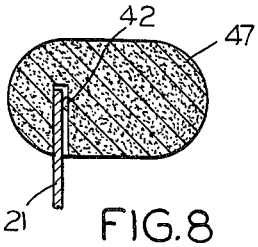
Figure 9:
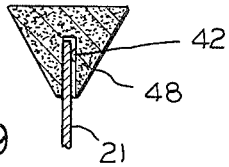
Figure 10:
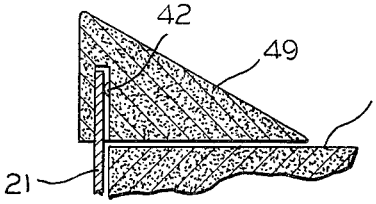

Surrounding the box 36 is a block of dense foam 43 (or the equivalent), which may have the length of an arm and any of many cross sectional shapes. Any suitable upholstery may be used to cover the dense foam block. For example, FIG. 6 shows cylindrical arm cushion 45, with a circular cross section. FIG. 7 shows a generally rectangular arm cushion 46, with a generally rectangular or square cross section. FIG. 8 shows an elongated arm cushion 47, with an oval or generally curved cross section. FIG. 9 shows an arm cushion 48 with a generally flat topped cross section. FIG. 10 shows a relatively long member 49 with a perpendicular triangular cross section, extending a substantial distance over the upper surface of the seat cushion 12, to make a chaise lounge.

It should also be apparent that the ladder back frame 15 may be turned by 90°, so that the back cushions 13, 14 may fit over and be supported by the upturned arms 21 of the ladder back frame 15.

The described structure provides a very flexible design which enables any suitable furniture, such as sofas, for example, to take on a great variety of different appearances. In greater detail, the frame 15 may be finished in any of many different suitable ways. It may have a chrome, brass, enameled, or stainless steel appearance. The cushions are all interchangeable. Therefore, the three seat cushions 10-12 may be interchanged or inverted to present any one of six different surfaces to view. This distributes wear and gives a substantial variation in appearance. The back cushions 13, 14 may be reversed to present either of two sides to view. One or two arm frames 15 may be removed or inserted between the cushions. They may be inserted between cushions 10, 11 or between 11, 12 to vary the height of the arm. The frames may also be turned by 90° to be opposed to the back cushions 13, 14 and thereby form a side cushion to keep a baby or elderly person from rolling off the front of the sofa. The cushions 10, 11, 12 may be spread on the floor to form one large or three small mattresses. The arm cushions may be removed and used as throw pillows.

it should now be apparent that the invention provides furniture having great flexibility. The person using the furniture may vary its appearance in any of many imaginative ways.

Those who are skilled in the art may readily perceive of modifications which may be used. Therefore, the appended claims are to be construed to cover all equivalent structures falling within the true scope and spirit of the invention.

I claim:

1. A cushion support comprising a ladder back frame having a long straight part, a curved part and a short straight part, said long straight part fitting under and held in place by a seat cushion, said seat cushion having dimensions which generally conform to the human anatomy in a seated position, said curved part extending out and around said seat cushion, and said short straight part being upturned and rising to a height which is a convenient arm height, with respect to the upper side of said cushion, cushion means supported by said upturned short part, wherein said cushion means comprises a foam material having pockets formed therein, said pockets being shaped, dimensioned and spaced to removably slip over and latch onto said upturned short ends.

2. The cushion support of claim 1 wherein said latch comprises means on said short straight part for releasably interconnecting said cushion means and said ladder back frame means.

3. The cushion support of claim 2 and a plurality of differently shaped cushion means, whereby different appearances may be created by releasing said latch and substituting said differently shaped cushion means.

4. The cushion support of claim 2 wherein said interconnecting means comprises a detent and a position fixing means.

5. The cushion support of claim 1 wherein said cushion means comprises an elongated cylindrical cushion with circular cross section.

6. The cushion support of claim 1 wherein said cushion means comprises an elongated cushion with rectangular cross section.

7. The cushion support of claim 1 wherein said cushion comprises an elongated cushion with a generally flat top.

8. The cushion support of claim 1 wherein said cushion comprises a generally triangular shape which cooperates with said seat cushion to form a chaise lounge.

9. The cushion support of claim 1 and wherein said cushion means comprises a foam material having pockets formed therein, said pockets being shaped, dimensioned and spaced to slip over said upturned short ends, said short straight part including detent and position fixing means for releasably interconnecting said cushion means and said ladder back frame means, and a plurality of differently shaped cushion means, whereby different appearances may be created by substitution of said differently shaped cushion means.

10. The cushion support of claim 1 wherein there are a plurality of different arm shapes, whereby different appearances may be created by substitution of different arm shapes, each arm shape comprising an arm cushion containing a spring loaded latch means in at least one pocket shaped to be attached to said short ends, and means on at least one of said short ends for cooperating with said latch to hold said arm cushion in place.

11. The cushion suppport of claim 1 and at least three cushions stacked directly upon the floor, at least a separate one of said frame means having said long straight part fitting between the upper two of said cushions and held in place solely by the weight of the cushion and anything resting thereon, said frame being shaped to rise adjacent the uppermost of said cushions to a comfortable arm position, and said cushion means forms an arm means supported by said frame means.

* * * * *